US011813504B2

(12) United States Patent
Hocknell et al.

(10) Patent No.: US 11,813,504 B2
(45) Date of Patent: Nov. 14, 2023

(54) GOLF CLUB HEAD WITH SOLE COMPLIANCE ZONE

(71) Applicant: Topgolf Callaway Brands Corp., Carlsbad, CA (US)

(72) Inventors: Alan Hocknell, Encinitas, CA (US); Brandon D. DeMille, Carlsbad, CA (US); Irina Ivanova, San Marcos, CA (US); William C. Watson, Temecula, CA (US); Timothy G. Scott, Encinitas, CA (US); Romulus M. Tomimbang, San Diego, CA (US); Justin Del Rosario, Temecula, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 0 days.

(21) Appl. No.: 17/935,547

(22) Filed: Sep. 26, 2022

(65) Prior Publication Data

US 2023/0105620 A1 Apr. 6, 2023

Related U.S. Application Data

(60) Provisional application No. 63/249,418, filed on Sep. 28, 2021.

(51) Int. Cl.
*A63B 53/04* (2015.01)

(52) U.S. Cl.
CPC ..... *A63B 53/0433* (2020.08); *A63B 53/0416* (2020.08); *A63B 53/0466* (2013.01)

(58) Field of Classification Search
CPC ..... A63B 53/0433; A63B 53/0437
USPC ..... 473/324–350
See application file for complete search history.

(56) References Cited

U.S. PATENT DOCUMENTS

| | | | | |
|---|---|---|---|---|
| 4,206,924 | A * | 6/1980 | Koralik | A63B 60/02 473/349 |
| 4,809,982 | A * | 3/1989 | Kobayashi | A63B 53/04 473/327 |
| 4,867,458 | A * | 9/1989 | Sumikawa | A63B 53/047 473/336 |
| 5,624,331 | A * | 4/1997 | Lo | A63B 53/0466 473/347 |
| 7,008,332 | B2 * | 3/2006 | Liou | A63B 53/0466 473/345 |
| 7,074,136 | B2 * | 7/2006 | Noguchi | A63B 60/52 473/346 |
| 7,258,624 | B2 * | 8/2007 | Kobayashi | A63B 53/0466 473/409 |

(Continued)

FOREIGN PATENT DOCUMENTS

| | | | | |
|---|---|---|---|---|
| CA | 2518641 | A1 * | 3/2006 | A63B 53/0466 |
| CA | 2608525 | A1 * | 6/2008 | A63B 53/04 |

(Continued)

*Primary Examiner* — Alvin A Hunter
(74) *Attorney, Agent, or Firm* — Michael A. Catania; Rebecca Hanovice; Sonia Lari

(57) ABSTRACT

A golf club head with a sole having a low stiffness compliance zone, which allows the face to deflect downward upon impact with a golf ball, is disclosed herein. The compliance zone comprises a plurality of through openings that are filled with one or more filler pieces comprising a low modulus material, all of which are located within three inches of a face section measured along a front-to-back axis of the golf club head.

20 Claims, 14 Drawing Sheets

(56) References Cited

U.S. PATENT DOCUMENTS 7,303,487 B2 * 12/2007 Kumamoto ..... A63B 53/0466 473/345
7,361,100 B1 * 4/2008 Morales ..... A63B 53/0466 473/348
8,814,723 B2 * 8/2014 Tavares ..... A63B 53/0466 473/335
8,915,797 B1 * 12/2014 Kuhar ..... A63B 53/0475 473/335
10,086,239 B2 * 10/2018 Myrhum ..... A63B 60/52
10,232,230 B2 * 3/2019 Takehara ..... A63B 53/0466
10,245,479 B2 * 4/2019 Murphy ..... A63B 60/50
10,343,030 B2 * 7/2019 Funaki ..... A63B 60/50
10,350,464 B2 * 7/2019 Myrhum ..... A63B 53/0466
10,434,380 B2 * 10/2019 Kawaguchi ..... A63B 60/50
10,441,855 B2 * 10/2019 Parsons ..... A63B 53/0466
10,537,769 B2 * 1/2020 Onuki ..... A63B 60/54
10,569,143 B2 * 2/2020 Funaki ..... A63B 53/0466
2004/0009829 A1 * 1/2004 Kapilow ..... A63B 60/00 473/345
2004/0147342 A1 * 7/2004 Lindsay ..... A63B 60/00 473/342
2005/0261082 A1 * 11/2005 Yamamoto ..... A63B 53/0466 473/345
2006/0058114 A1 * 3/2006 Evans ..... A63B 60/00 473/345
2010/0056298 A1 * 3/2010 Jertson ..... A63B 60/00 228/101
2011/0212795 A1 * 9/2011 Jertson ..... A63B 53/0466 473/345
2012/0178550 A1 * 7/2012 Solheim ..... A63B 60/52 473/345
2012/0202615 A1 * 8/2012 Beach ..... A63B 60/52 473/345
2012/0289361 A1 * 11/2012 Beach ..... A63B 53/0466 473/335
2013/0178306 A1 * 7/2013 Beno ..... A63B 60/52 473/307
2013/0210542 A1 * 8/2013 Harbert ..... A63B 53/02 473/338
2013/0331201 A1 * 12/2013 Wahl ..... A63B 53/047 473/329
2014/0057737 A1 * 2/2014 Solheim ..... A63B 53/08 29/527.1
2015/0133232 A1 * 5/2015 Taylor ..... A63B 53/0475 473/329
2016/0023063 A1 * 1/2016 Willett ..... A63B 53/0466 29/401.1
2016/0038796 A1 * 2/2016 Taylor ..... A63B 60/00 473/349
2016/0158610 A1 * 6/2016 Parsons ..... A63B 60/54 473/346
2017/0340932 A1 * 11/2017 Morales ..... A63B 53/0466
2021/0162280 A1 * 6/2021 Morales ..... A63B 53/0466
2023/0105620 A1 * 4/2023 Hocknell ..... A63B 53/0458 473/324

FOREIGN PATENT DOCUMENTS

CN 104540558 A * 4/2015 ..... A63B 53/02
GB 2450764 A * 1/2009 ..... A63B 53/04
JP 2016106885 A * 6/2016 ..... A63B 53/0466
WO WO-2016115576 A1 * 7/2016 ..... A63B 53/04

* cited by examiner

GOLF CLUB HEAD WITH SOLE COMPLIANCE ZONE

CROSS REFERENCES TO RELATED APPLICATIONS

The present application claims priority to U.S. Provisional Patent Application No. 63/249,418, filed on Sep. 28, 2021, the disclosure of which is hereby incorporated in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a hollow golf club head, and particularly a fairway wood-type golf club head, with a compliance zone in the sole that optimizes deflection of the face during impact with a golf ball.

Description of the Related Art

Many golfers have a swing that does not easily allow for a descending attack angle as their golf club head approaches a golf ball. This does not create a problem for tee shots, as the ball is elevated from the ground and there is plenty of room for the player to position the lower half of the club beneath the center of the golf ball prior to impact. However, for shots taken off of a tight lie, swings with a level or ascending attack angle tend to result in impact locations very low on the golf club face, which have much lower ball speeds and non-optimal backspin and launch angle compared with shots generated from face center impacts. This is especially problematic in fairway woods, where the relatively small amount of loft coupled with a low impact location results in an extremely low launch angle. The ball speed drop-off on fairway woods as hit location moves below the face center is also more severe than on drivers due to the overall size of the face and the increase in face stiffness closer to the face boundary. Therefore, there is a need for a golf club head, and in particular a fairway wood head, with an improved design that improves launch conditions for shots hit low on the face.

BRIEF SUMMARY OF THE INVENTION

One aspect of the present invention is a golf club head with a sole compliance zone, an area in the sole proximate the face with a lower stiffness than prior art golf club heads so as to change the launch conditions (ball speed, launch angle, backspin) for shots low on the face.

Another aspect of the present invention is a golf club head comprising a body comprising a face portion with a face opening, a return section, a sole section, a heel side, a toe side, an aft end, and a hosel, a crown insert, a face cup sized to fit within the face opening, and at least one plug, wherein the sole section comprises a compliance zone located within three inches of the face portion measured along a front-to-back x-axis, wherein the compliance zone comprises a plurality of through-openings, and wherein each of the plurality of through-openings is filled with the at least one plug. In some embodiments, at least one of the plurality of through-openings may be circular. In other embodiments, the plurality of through-openings may comprise twenty through-openings. In a further embodiment, the at least one plug may comprise twenty plugs, and each of the twenty through-openings may be filled with one of the twenty plugs. In any of the embodiments, the golf club head may be a fairway wood-type golf club head.

In other embodiments, the at least one plug may be a secondary filler piece comprising a base portion and a plurality of extensions, each of the plurality of extensions may extend from the base portion, and each of the plurality of extensions may fill one of the plurality of through-openings. In a further embodiment, the secondary filler piece may comprise an inner portion and a cover piece, the inner piece may be composed of a high-density material, and the cover piece may be composed of a material having a lower density than the high-density material. In some embodiments, the inner portion may be metal injection molded and the cover piece may be overmolded over the inner portion. In other embodiments, the cover piece may comprise each of the plurality of extensions. In yet another embodiment, the body may further comprise a plurality of pegs extending from an interior surface of the sole portion within the compliance zone, each peg of the plurality of pegs may be disposed behind a through-opening of the plurality of through-openings, the base portion of the secondary filler piece may comprise a plurality of sockets, and each peg of the plurality of pegs may be sized to fit within a socket of the plurality of sockets.

In another embodiment, the plurality of through-openings may be disposed proximate to and is aligned parallel with the face opening. In another embodiment, the plurality of through-holes may vary in shape, size, and length across the compliance zone. In yet another embodiment, the compliance zone may comprise a variable thickness ranging from 0.01 inch to inch. In still another embodiment, each of the face cup and the body may be composed of a metal material, and wherein the crown insert is composed of a non-metal material. In any embodiment, the face cup may be composed of a first metal material, the body may be composed of a second metal material, and the first metal material may be different from the second metal material.

Another aspect of the present invention is a fairway wood golf club head comprising a body comprising a face portion with a face opening, a crown section, a sole section, a heel side, a toe side, an aft end, and a hosel, a face component sized to fit within the face opening, and a filler piece comprising a base portion, a plurality of extensions, an inner portion composed of a first material, and a cover piece composed of a second material that has a lower density than the first material, wherein the sole section comprises a compliance zone located within three inches of the face portion measured along a front-to-back x-axis, wherein the compliance zone has a variable thickness ranging from 0.01 inch to 0.05 inch and comprises a plurality of through-openings, wherein each of the plurality of through-openings is filled with an extension of the plurality of extensions, and wherein the face component is selected from the group consisting of a face insert and a face cup.

In some embodiments, the plurality of through-openings may be disposed proximate to and be aligned parallel with the face opening. In other embodiments, the plurality of through-holes may vary in shape, size, and length across the compliance zone. In yet another embodiment, the cover piece may comprise each of the plurality of extensions.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
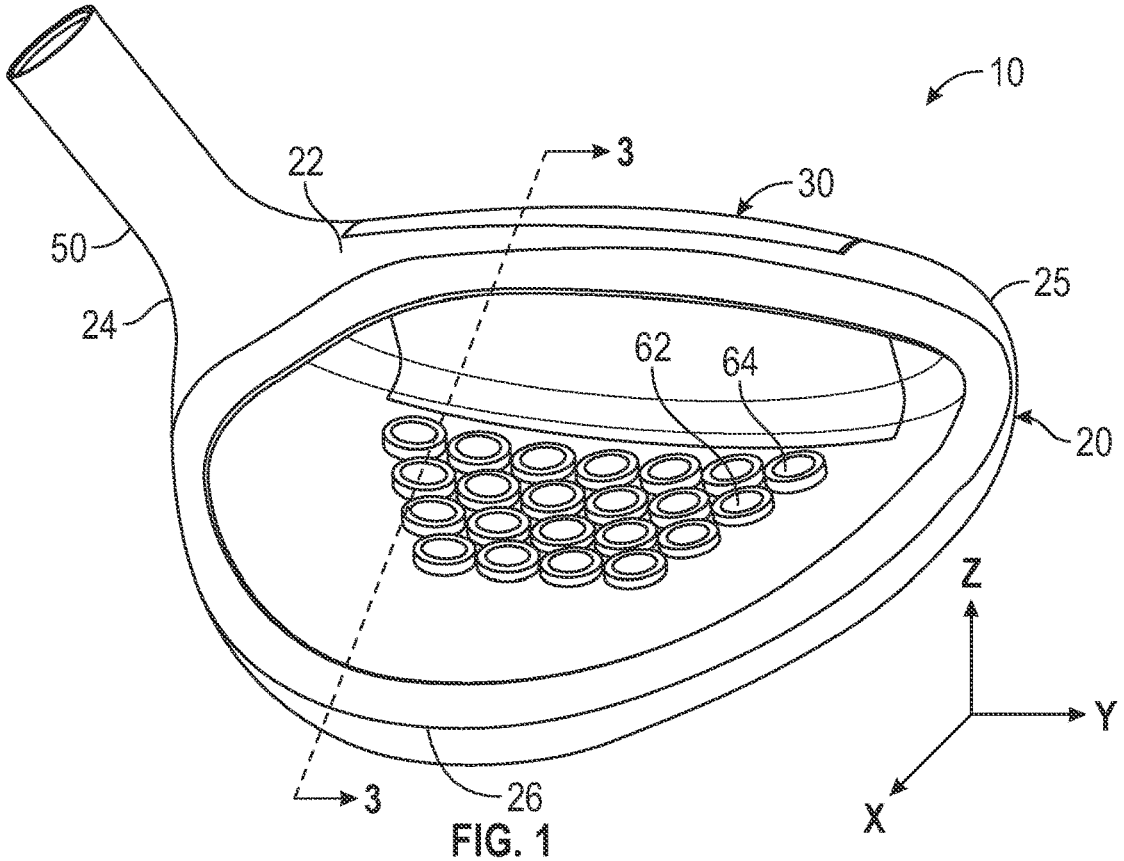
FIG. 1 is a top perspective view of a first embodiment of the golf club head of the present invention with a crown insert removed.
Figure 2:
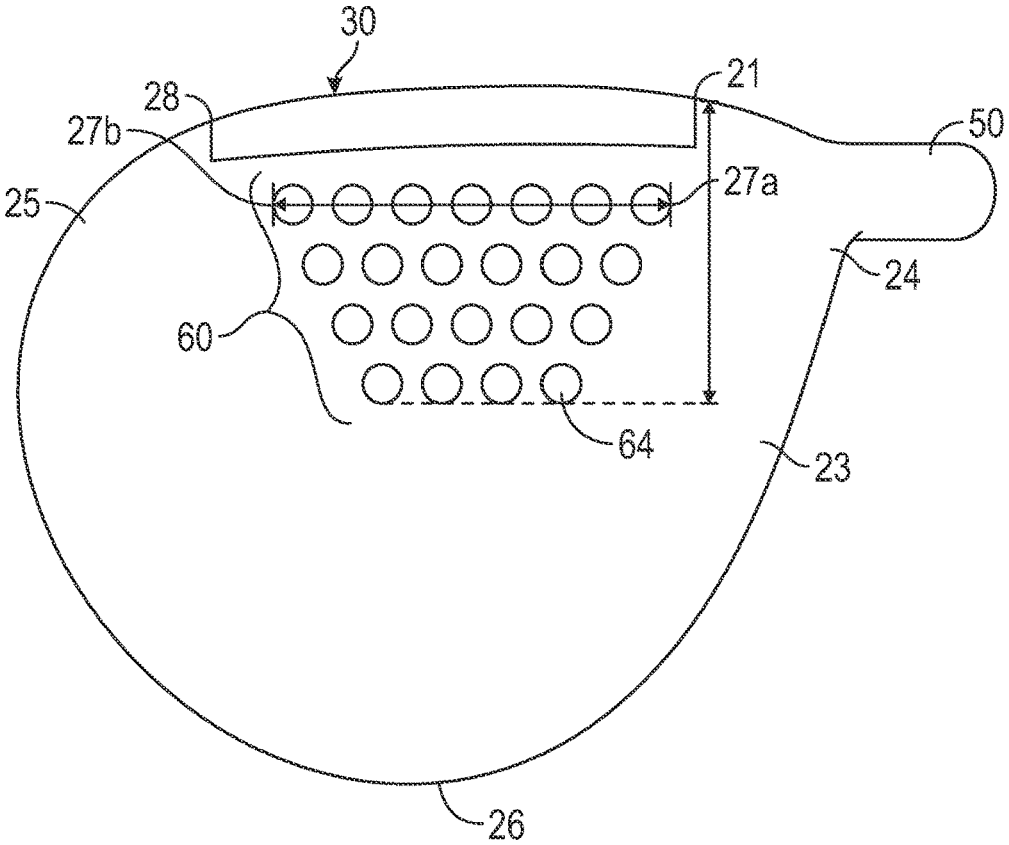
FIG. 2 is a sole plan view of the embodiment shown in FIG. 1.
Figure 3:
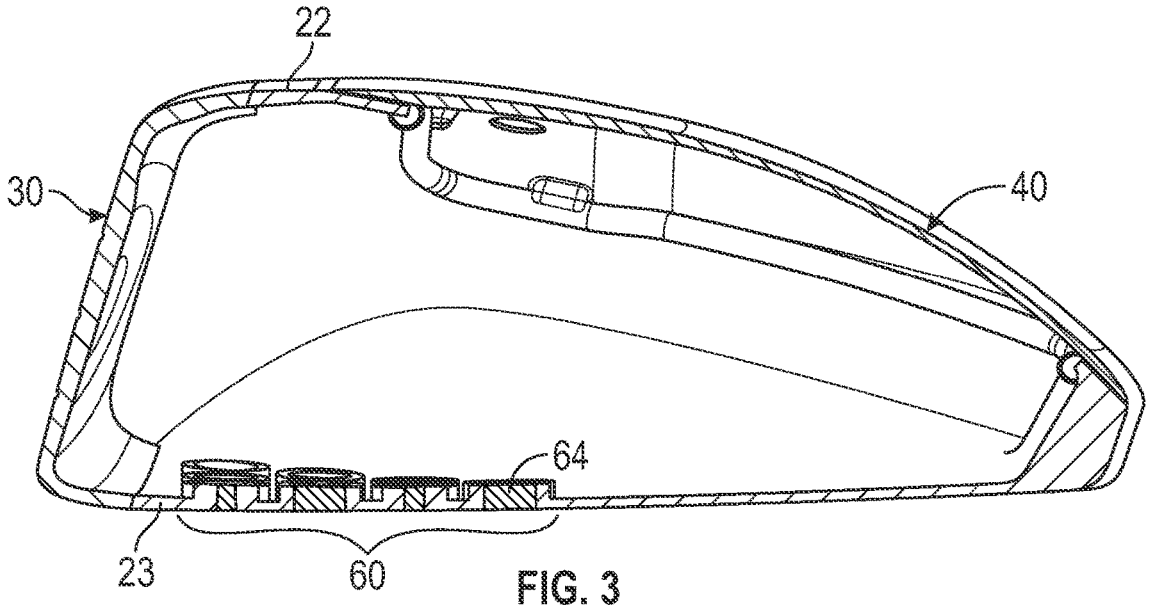
FIG. 3 is a cross-sectional view of the embodiment shown in FIG. 1 taken along lines 3-3.
Figure 4:
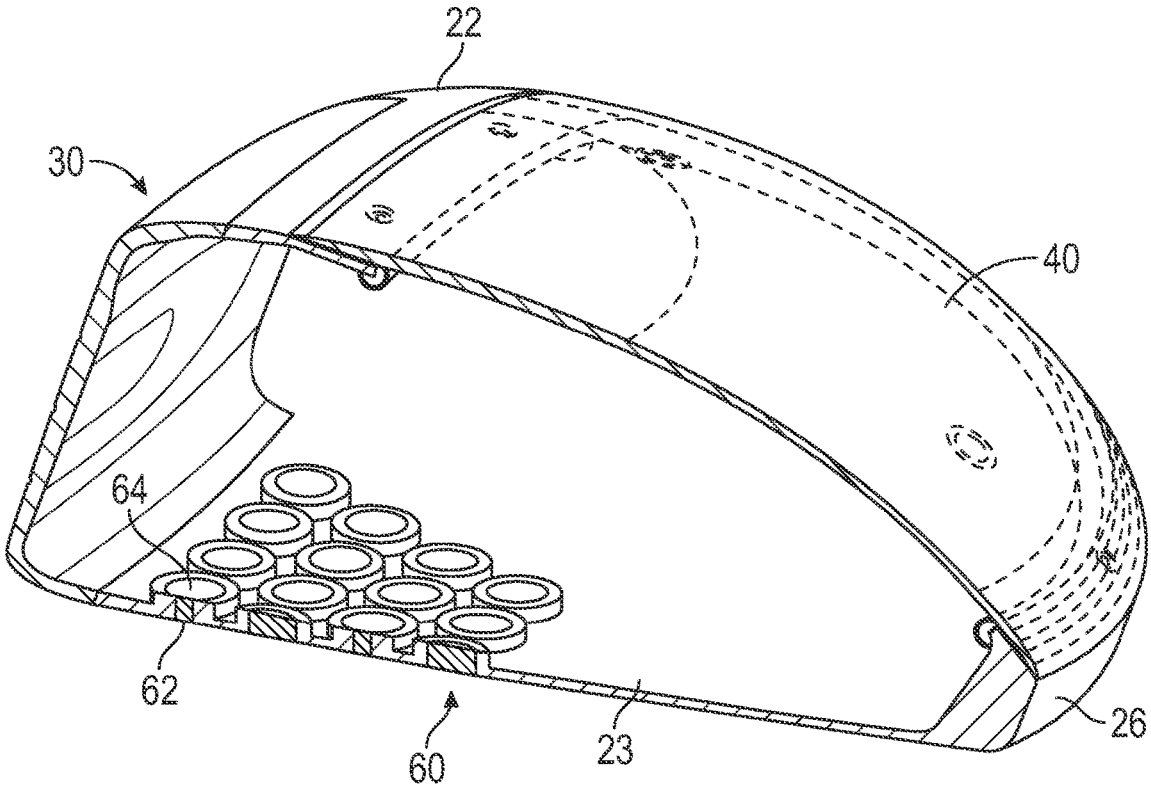
FIG. 4 is a side perspective view of the embodiment shown in FIG. 3.

The present invention is directed to a golf club head, and particularly a hollow fairway wood head, with a sole compliance zone located proximate the face. The sole compliance zone is a low stiffness region that affects the magnitude of club head deflection upon impact with a golf ball and causes the face to deflect downwards during that impact, allowing the face to move upwards during recovery from initial deflection as the ball leaves the face. The head deflection mode shapes should occur at frequencies similar to the face mode, or 2000 to 7000 Hz, more preferably 3000 to 60000 Hz, and most preferably 4000 to 5000 Hz. This altered face motion imparts a higher launch angle and lower backspin to the golf ball than it would with prior art constructions.

A first embodiment of this invention is shown in FIGS. 1-5A. In this embodiment, the golf club head 10 is a fairway wood with a body 20 with a face opening 21 in a front surface 28, a return section 22, a sole section 23, a heel side 24, a toe side 25, and an aft end 26, a face cup 30, a crown insert 40, and a hosel 50. The sole section 23 includes the compliance zone 60, which is located within three inches of the front surface 28 measured along the front to back x-axis and extends from a first location 27*a* within one inch of the heel side 24 to a second location 27*b* within one inch of the toe side 25. In other embodiments, the golf club head 10 may have a face insert instead of a face cup 30, and the crown portion may be integrally cast, forged, formed, etc. with the body so that there is no need for a separate crown insert 40. In still other embodiments, the striking face 32 may be integrally cast, forged, formed, etc. with the body so that there is no need for a separate face cup 30 or face insert.

The compliance zone 60 of the first embodiment comprises a plurality of through-openings 62 filled with plugs 64 composed of a low-density elastomeric material, such as rubber. The through-openings 62 are circular, but may have different shapes, such as those disclosed in U.S. Pat. No. 9,782,642, the disclosure of which is hereby incorporated by reference in its entirety herein. In the first embodiment, there are twenty-two through-openings 62 filled with separate plugs 64.

In alternative embodiments, the plugs 64 may be connected by a thin membrane or other connective material such that there is a single, secondary filler piece 65 that serves to fill all of the through-openings 62. There may also be a different number of through-openings 62 with larger or smaller diameters and different shapes of varying size. These concepts are illustrated by the second, preferred embodiment shown in FIGS. 6-13, the third embodiment shown in FIGS. 14-19, and the fourth embodiment shown in FIGS. 20-29.

As shown in FIGS. 6-13, the fairway wood golf club head 10 has most of the same characteristics as the first embodiment, except that there are fewer through-openings 62 and these through-openings 62 are filled with a secondary filler piece 65 comprising a base section 66 and a plurality of extensions 67 sized to fit within the through-openings 62. This filler piece 65 is composed of a high density, metal injection molded inner portion 68 that is then overmolded with a cover piece 69 made of a lower modulus material. The inner portion 68 is metal injection molded to allow the manufacturer greater control over its shape and density, and the cover piece 69 is designed to be bonded to the inside of the sole 23. The multiple material composition of the filler piece 65 allows the manufacturer to tune its stiffness so that, when the filler piece 65 is bonded into the body 20, the stiffness is correct for the coefficient of restitution (COR) and the weight is correctly positioned to provide a low center of gravity (CG). The third embodiment, shown in FIGS. 14-19, has most of the same characteristics as the second embodiment, except that the through-holes 62 vary in size, shape, and length across the compliance zone 60.

In the fourth embodiment, shown in FIGS. 20-29, the through-openings 62 are all disposed proximate to and parallel with the face opening 21, and the filler piece 65 is configured so that only the lower modulus cover piece 69 comprises the extensions 67 that engage with and fill the through-holes 62. In this way, the portion of the filler piece 65 comprising a low modulus material is closest to the striking face 32 when the face cup 30 is fully engaged with the body 20. Behind each through-opening 62 is a peg or extension 61*a* that engages a socket 61*b* within the cover piece 69 to help orient the cover piece 69 within the compliance zone 60 and provides additional bonding area. As shown in FIGS. 21, 26, 27, and 29, the inner portion 68 and cover piece of the filler piece 65 are shaped so that they fit together like puzzle pieces.

Figure 5A:
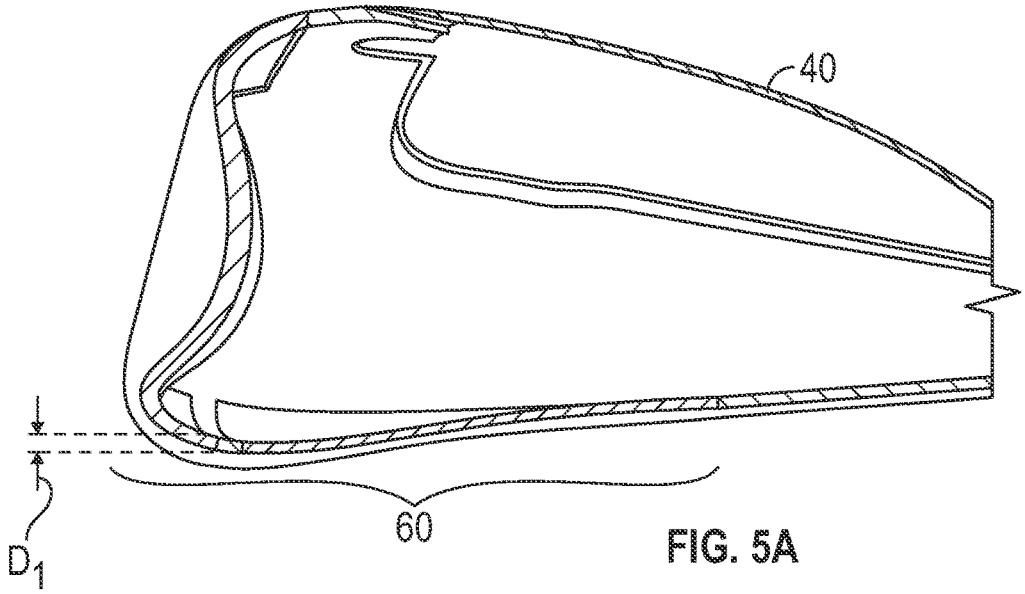
FIGS. 5A-5C are cross-sectional views of the embodiment shown in FIG. 1 with different sole thicknesses.
Figure 5B:
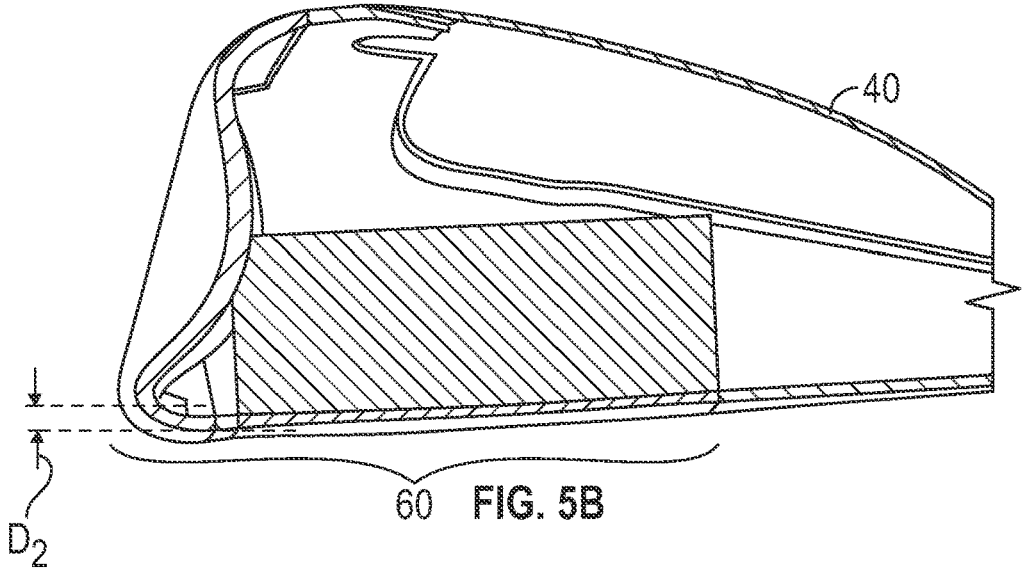
Figure 5C:
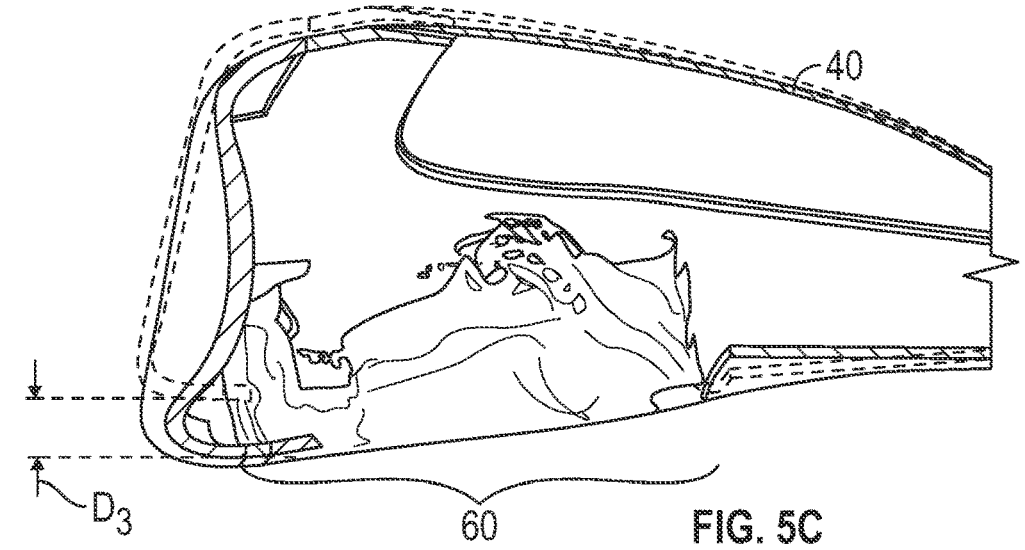
Figure 6:
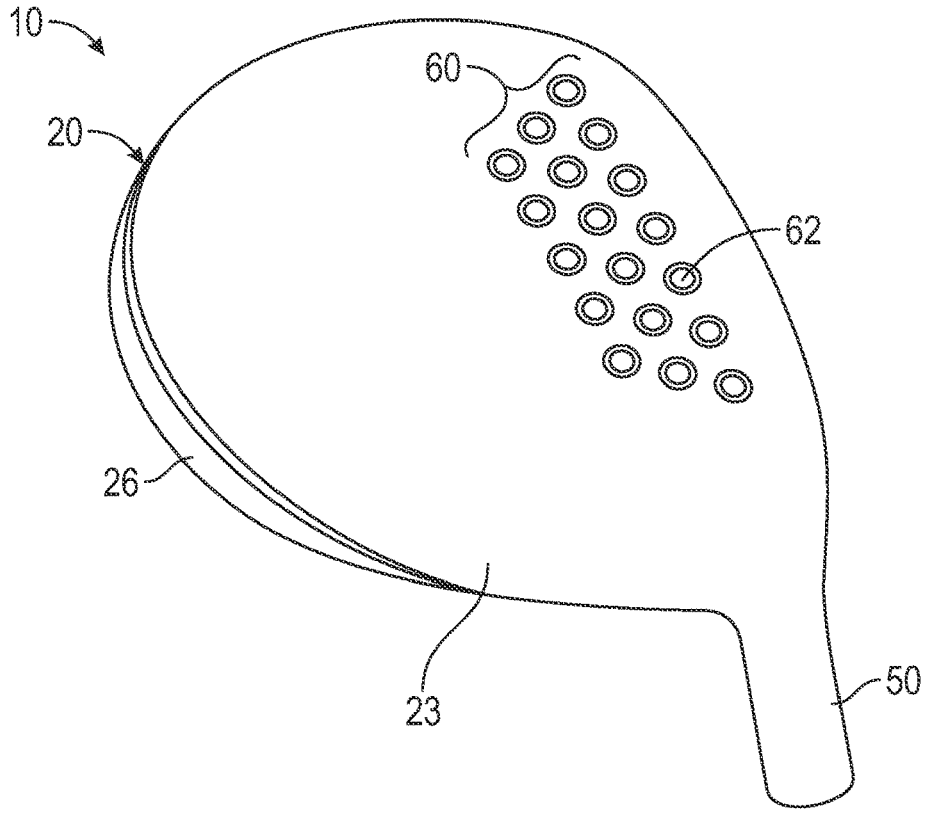
FIG. 6 is a sole perspective view of a second embodiment of the golf club head of the present invention.
Figure 7:
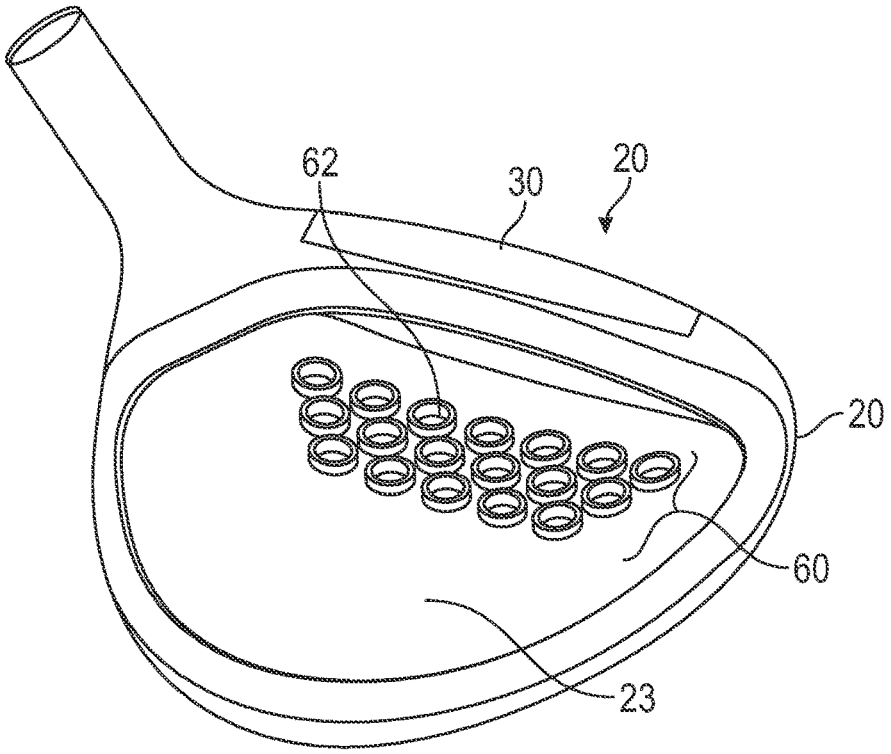
FIG. 7 is a top perspective view of the embodiment shown in FIG. 6 with a crown insert and filler piece removed.
Figure 8:
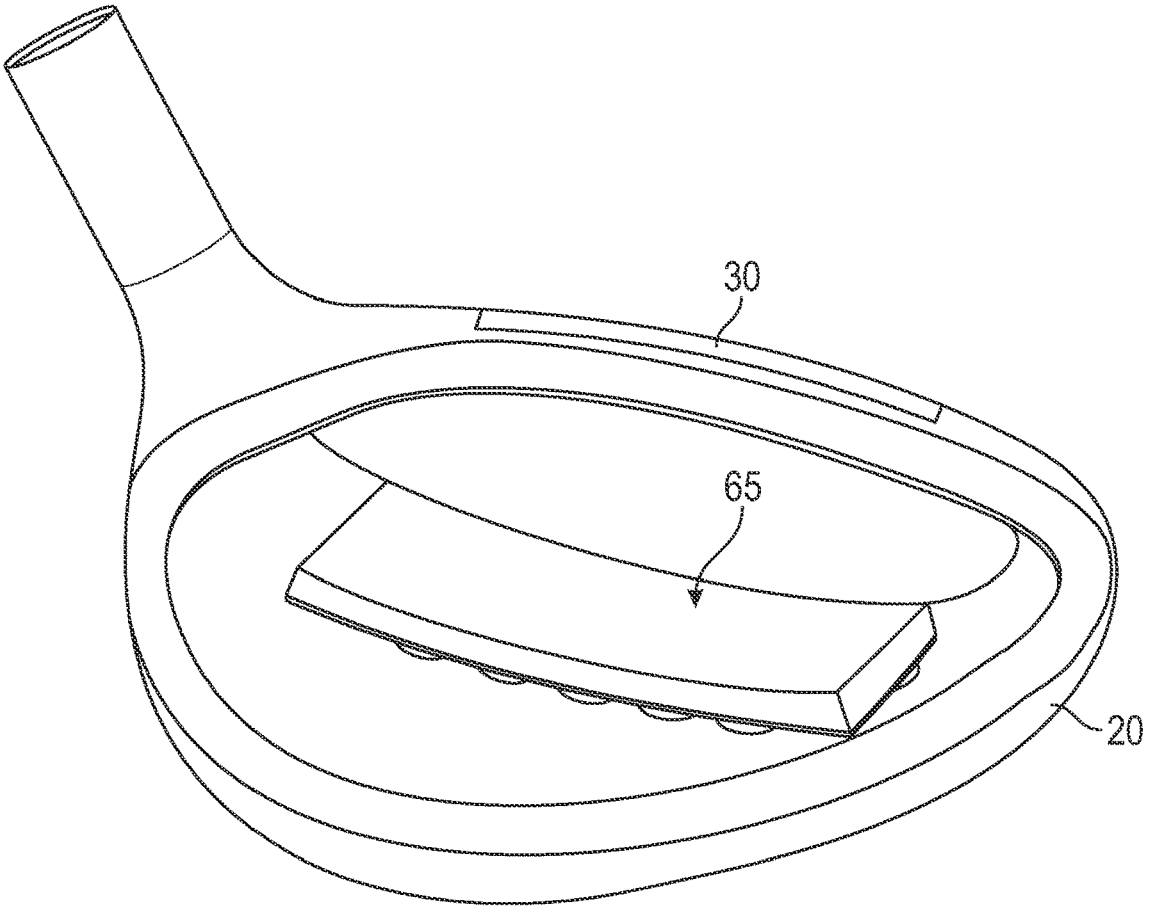
FIG. 8 is a top perspective view of the embodiment shown in FIG. 7 with the filler piece engaged with the compliance zone.
Figure 9:
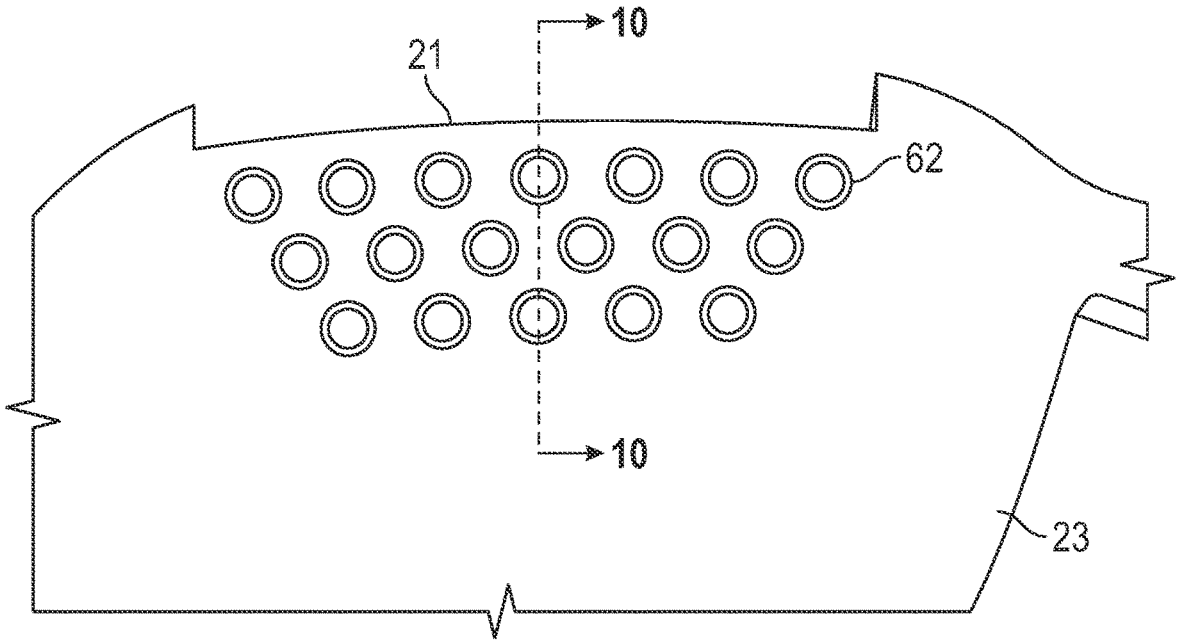
FIG. 9 is a sole plan view of the embodiment shown in FIG. 8 with the face cup removed.
Figure 10:
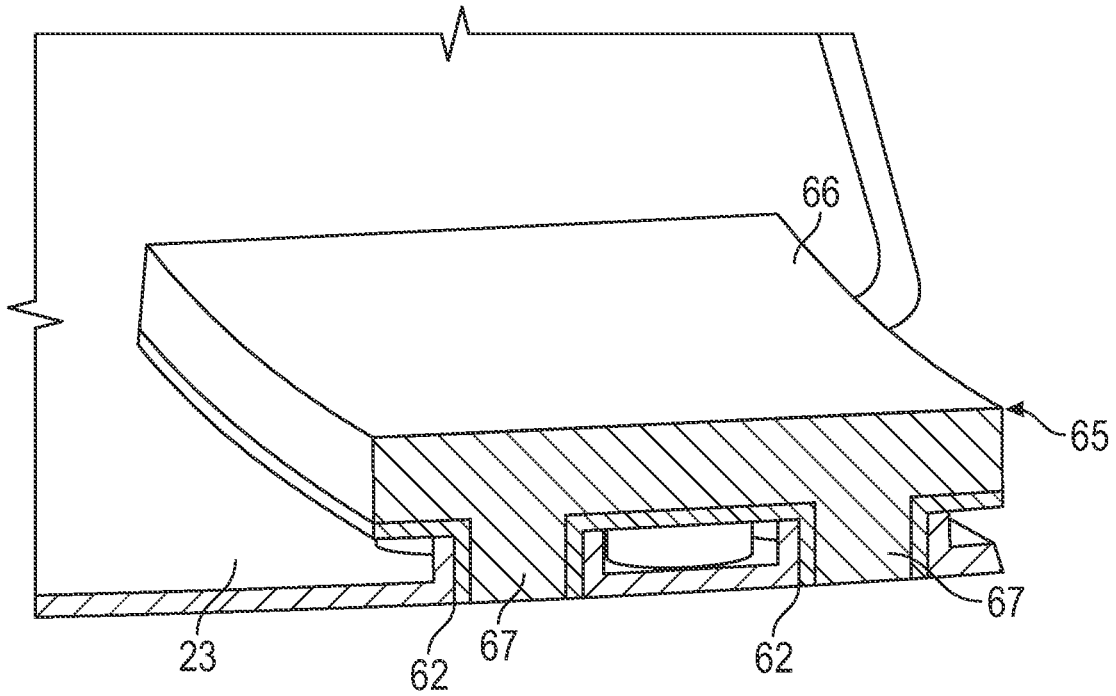
FIG. 10 is a cross-sectional view of the embodiment shown in FIG. 9 taken along lines 10-10.
Figure 11:
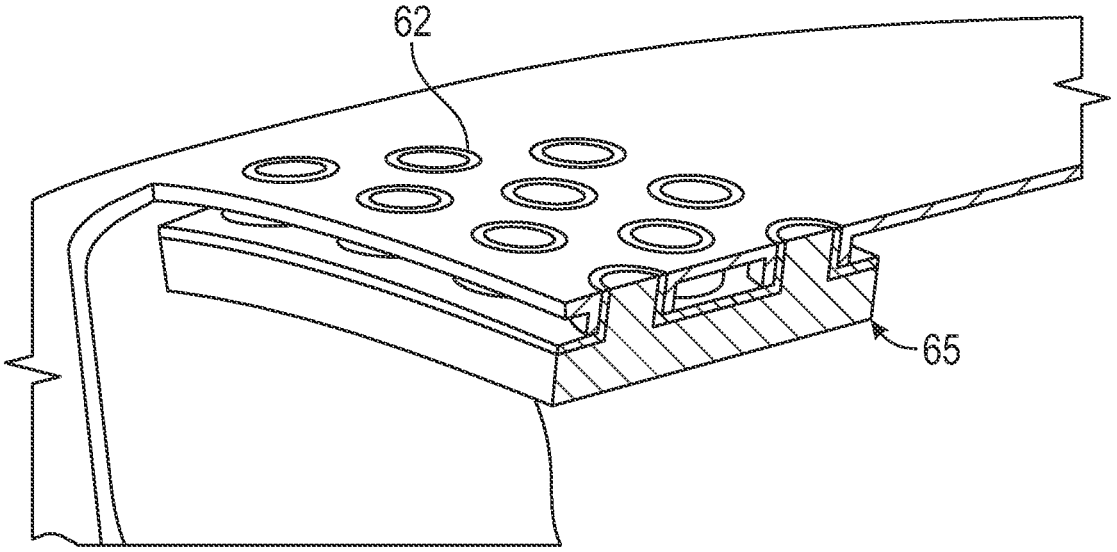
FIG. 11 is a sole perspective view of the embodiment shown in FIG. 10.
Figure 12:
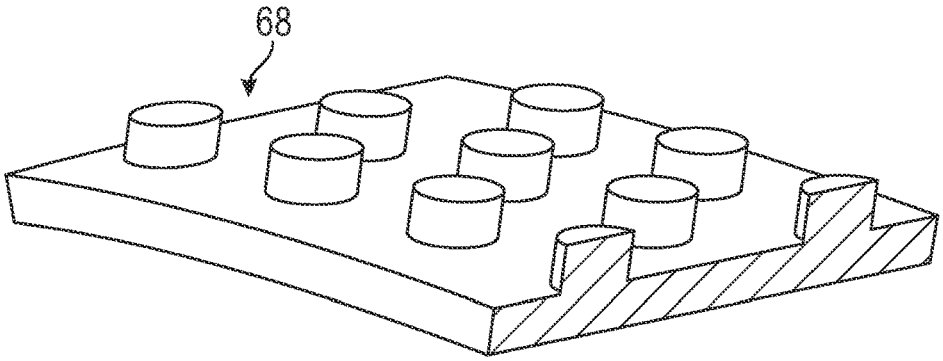
FIG. 12 is bottom perspective view of the inner portion of the filler piece shown in FIG. 8.
Figure 13:
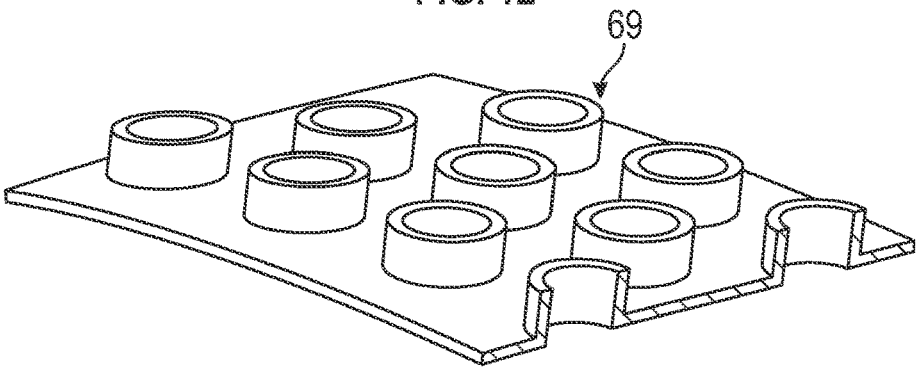
FIG. 13 is a top perspective view of the cover piece of the filler piece shown in FIG. 8.
Figure 14:
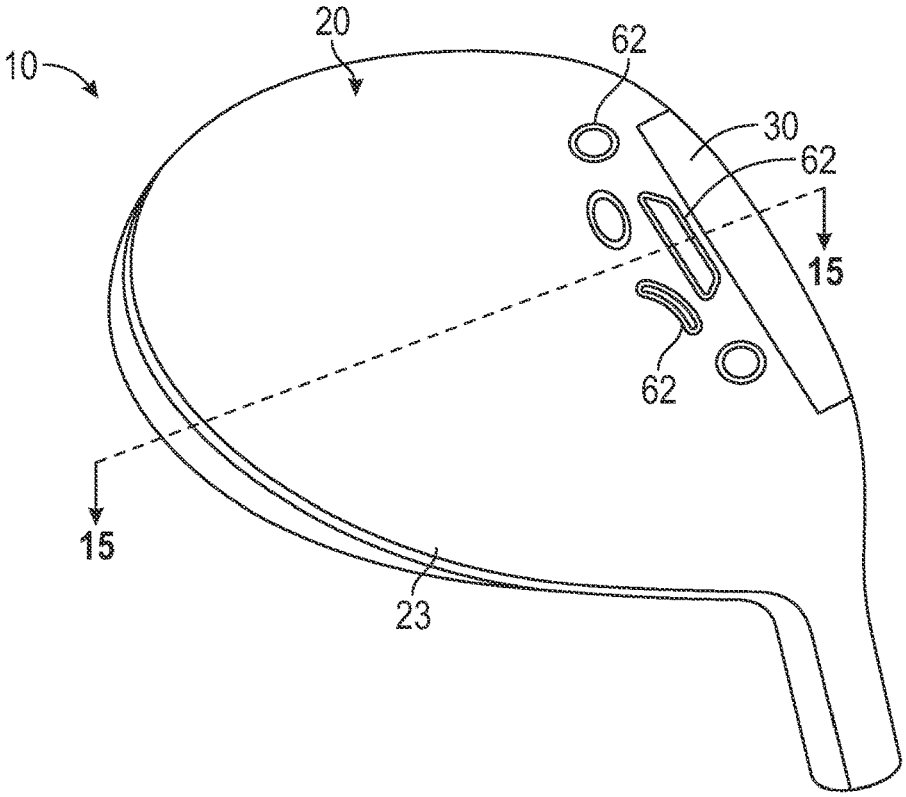
FIG. 14 is a sole perspective view of a third embodiment of the golf club head of the present invention.
Figure 15:
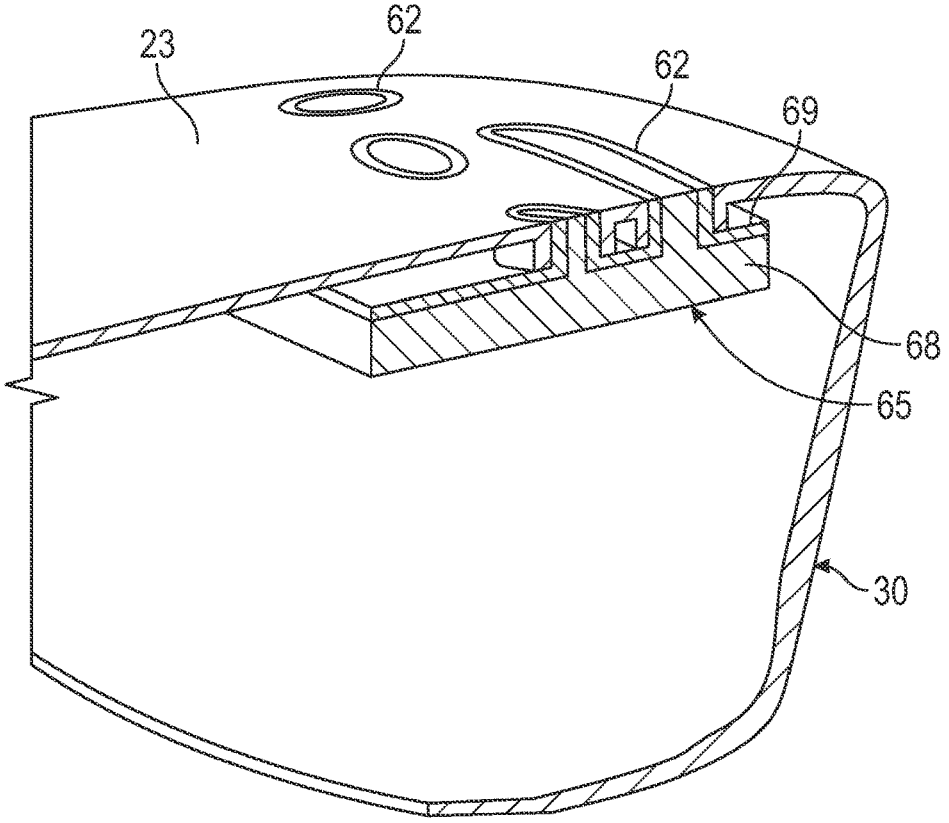
FIG. 15 is a cross-sectional view of the embodiment shown in FIG. 14 taken along lines 15-15.
Figure 16:
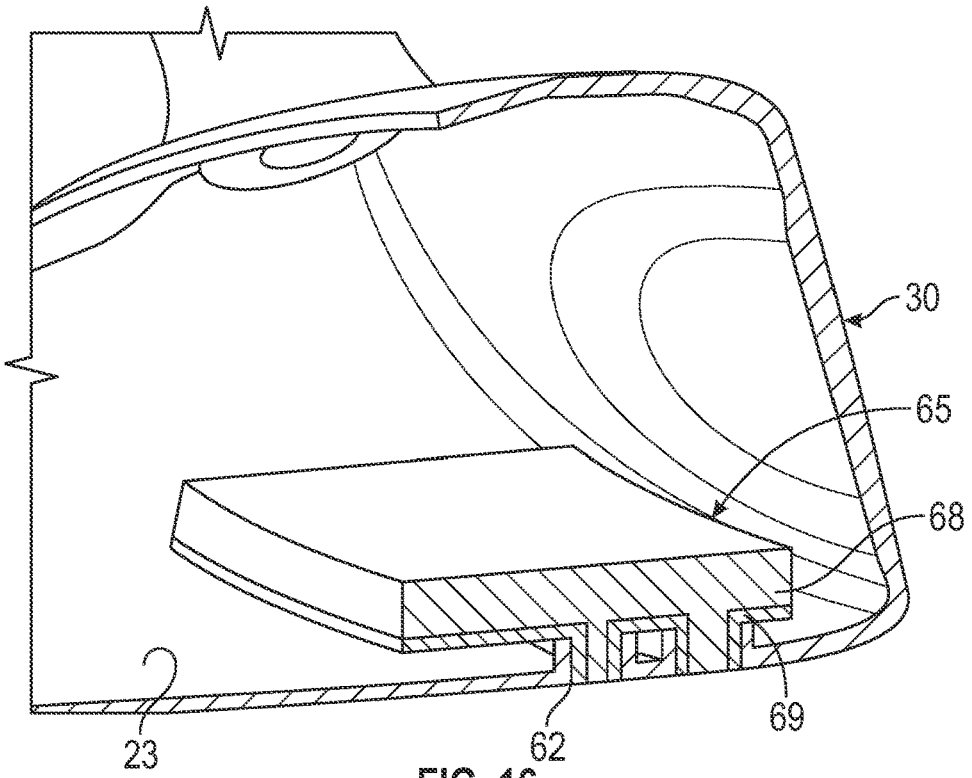
FIG. 16 is another view of the embodiment shown in FIG. 15.
Figure 17:
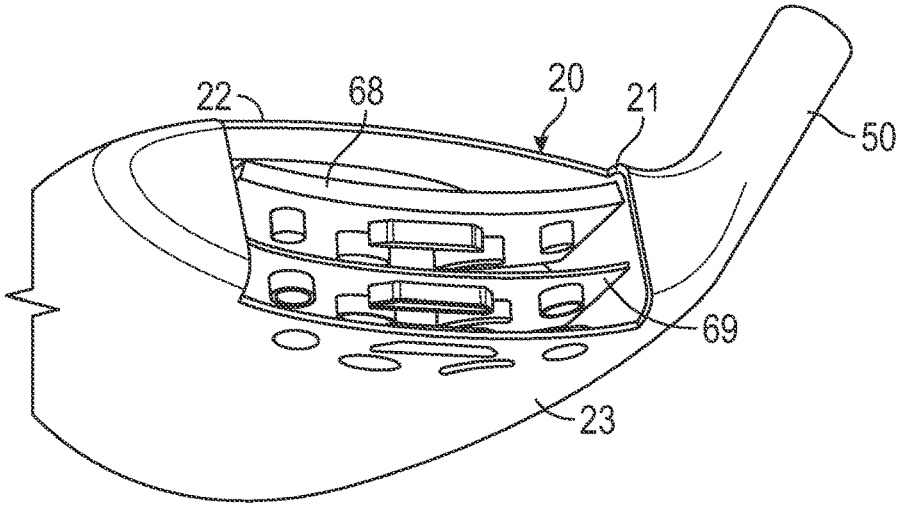
FIG. 17 is a front perspective, exploded view of the embodiment shown in FIG. 14 with the face cup removed.
Figure 18:
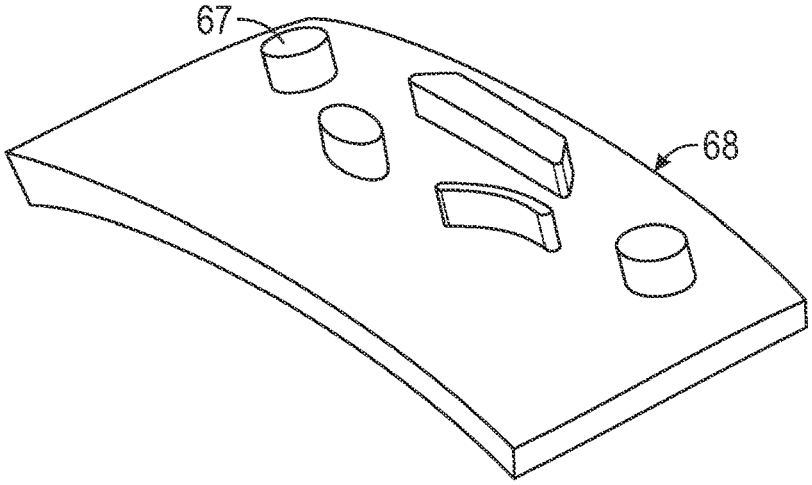
FIG. 18 is bottom perspective view of the inner portion of the filler piece shown in FIG. 17.
Figure 19:
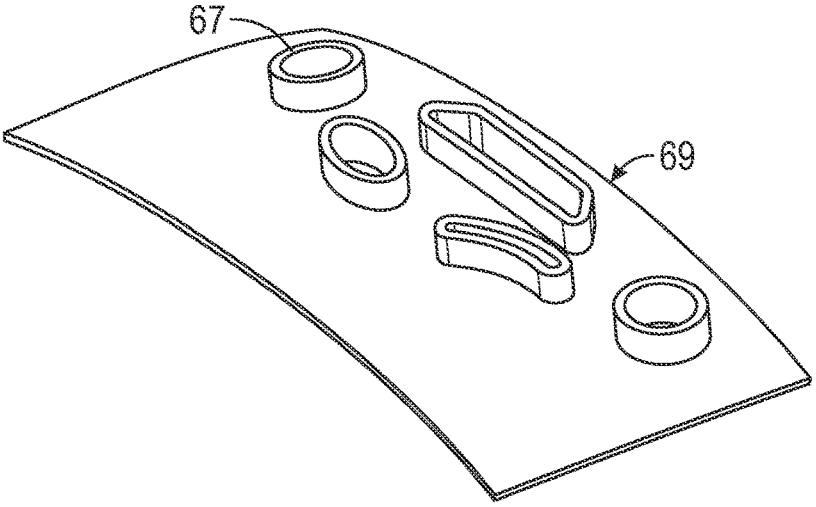
FIG. 19 is a top perspective view of the cover piece of the filler piece shown in FIG. 17.
Figure 20:
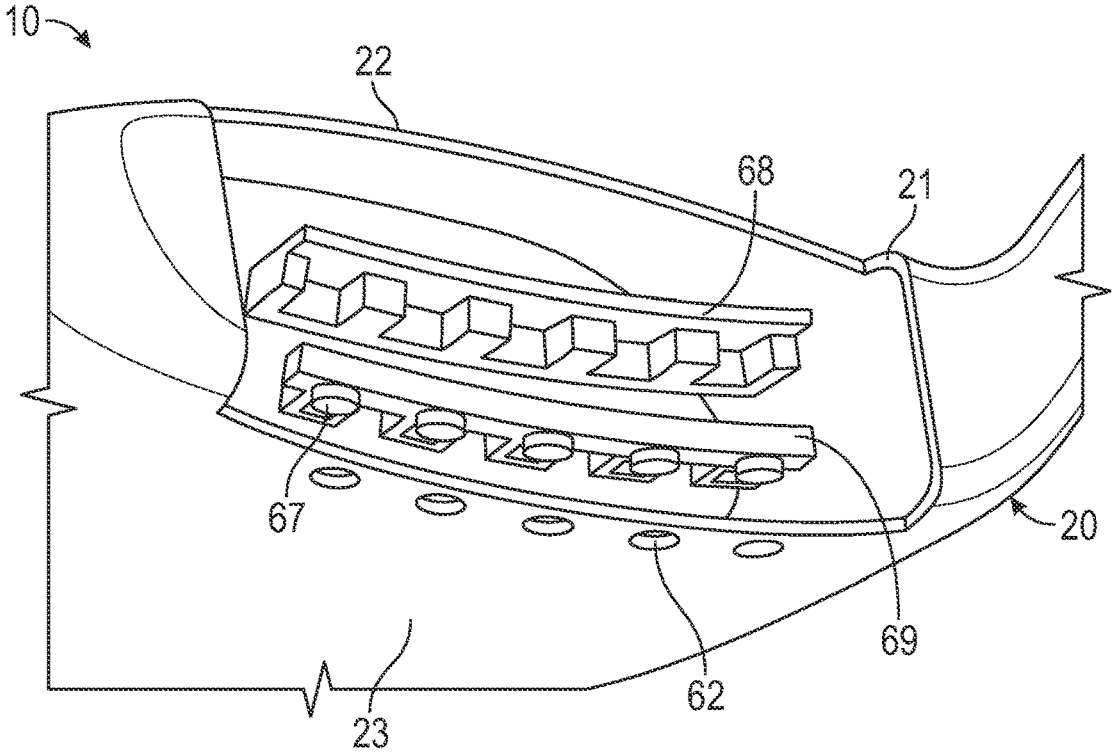
FIGS. 20-21 are front perspective, exploded views of a fourth embodiment of the golf club head of the present invention.
Figure 21:
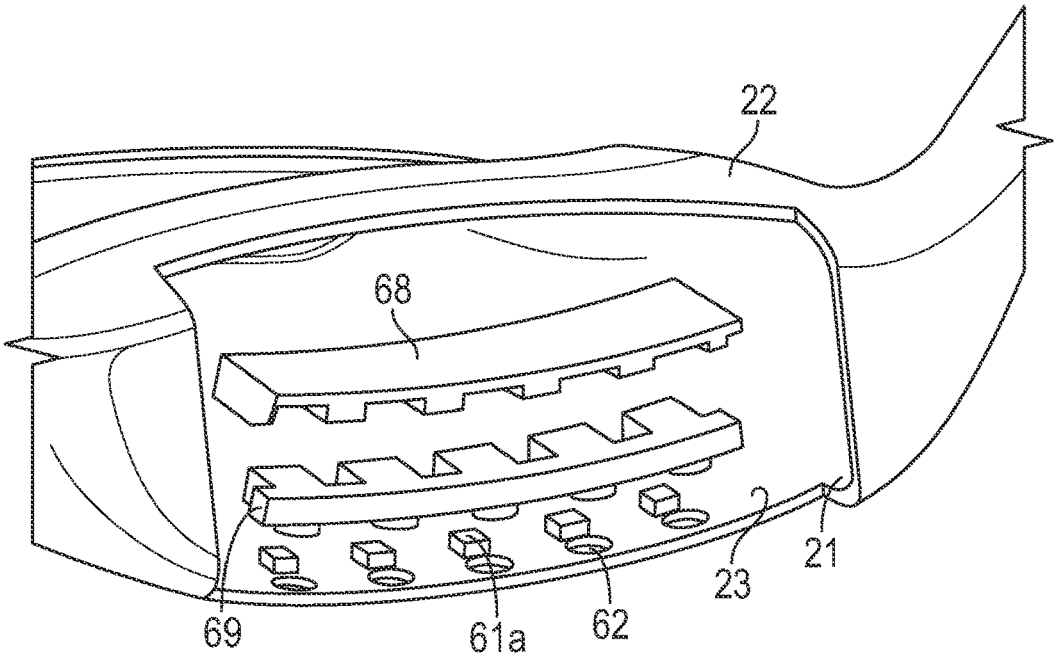
Figure 22:
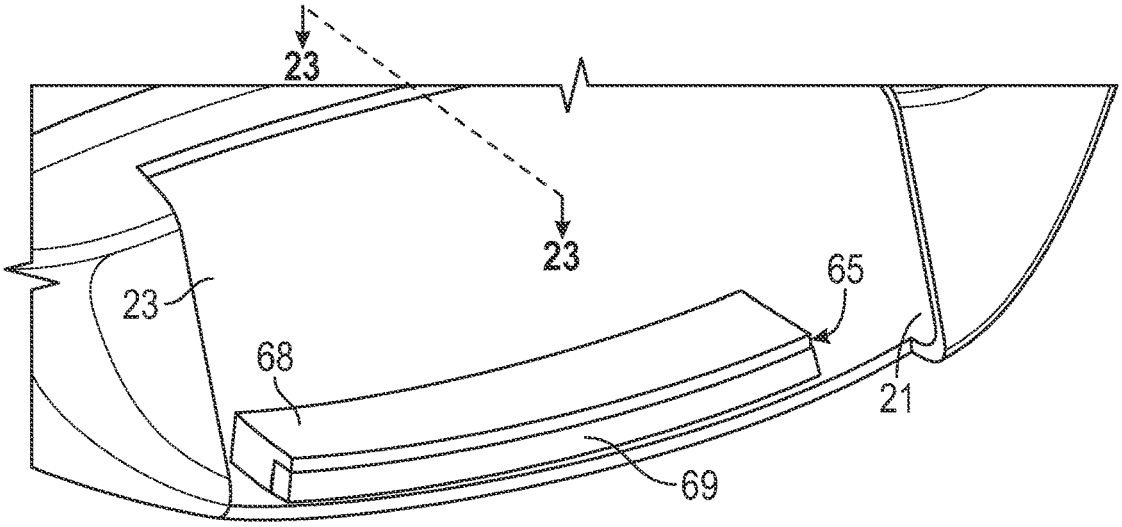
FIG. 22 is an assembled view of the embodiment shown in FIGS. 20-21.
Figure 23:
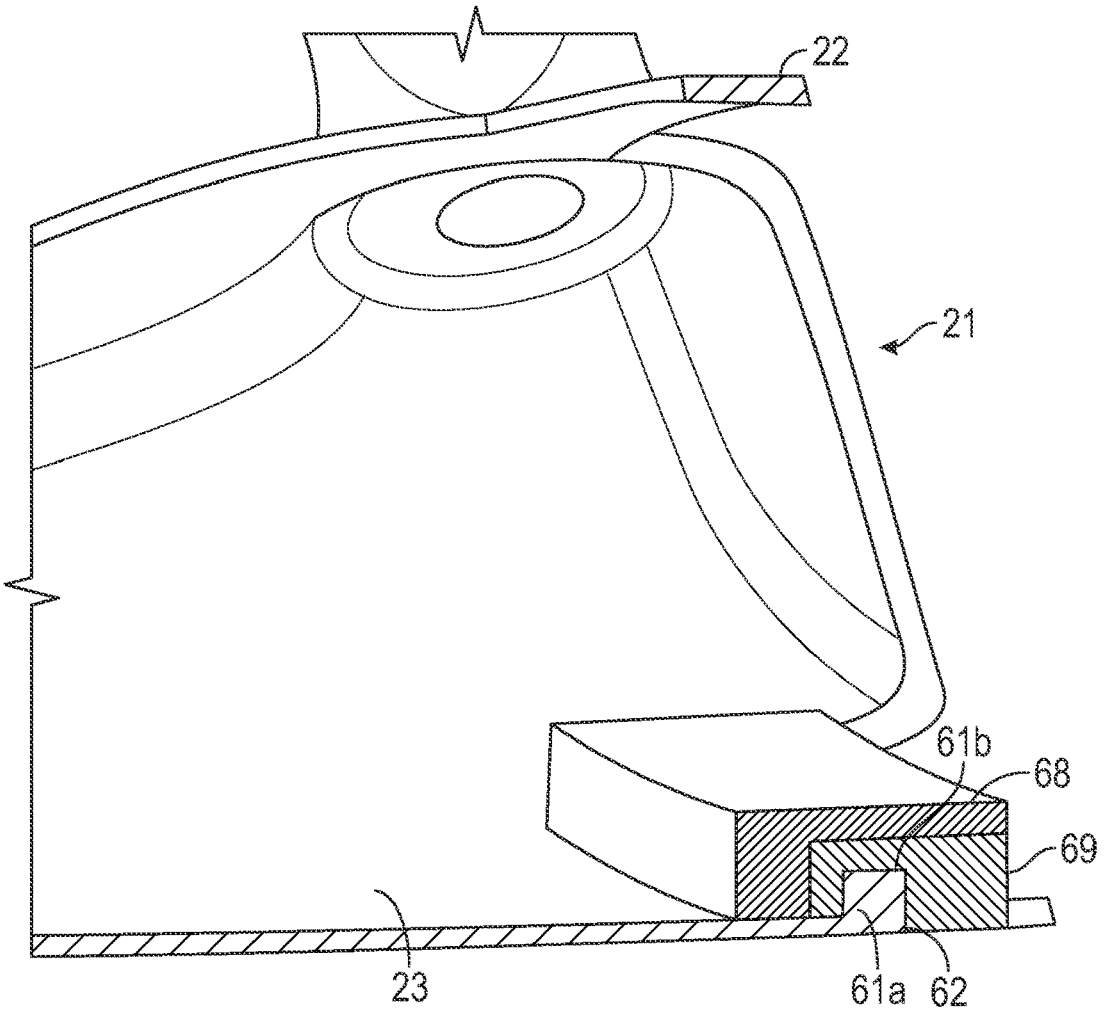
FIG. 23 is a cross-sectional view of the embodiment shown in FIG. 22 taken along lines 23-23.
Figure 24:
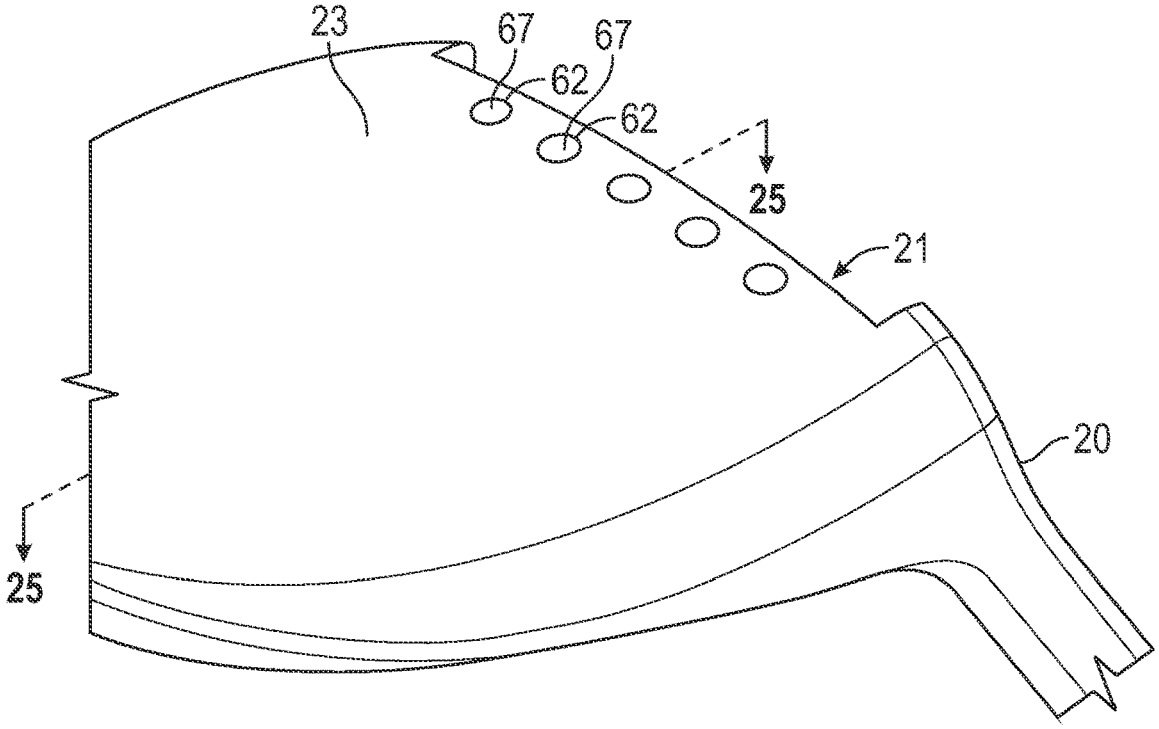
FIG. 24 is a sole perspective view of the embodiment shown in FIG. 22.
Figure 25:
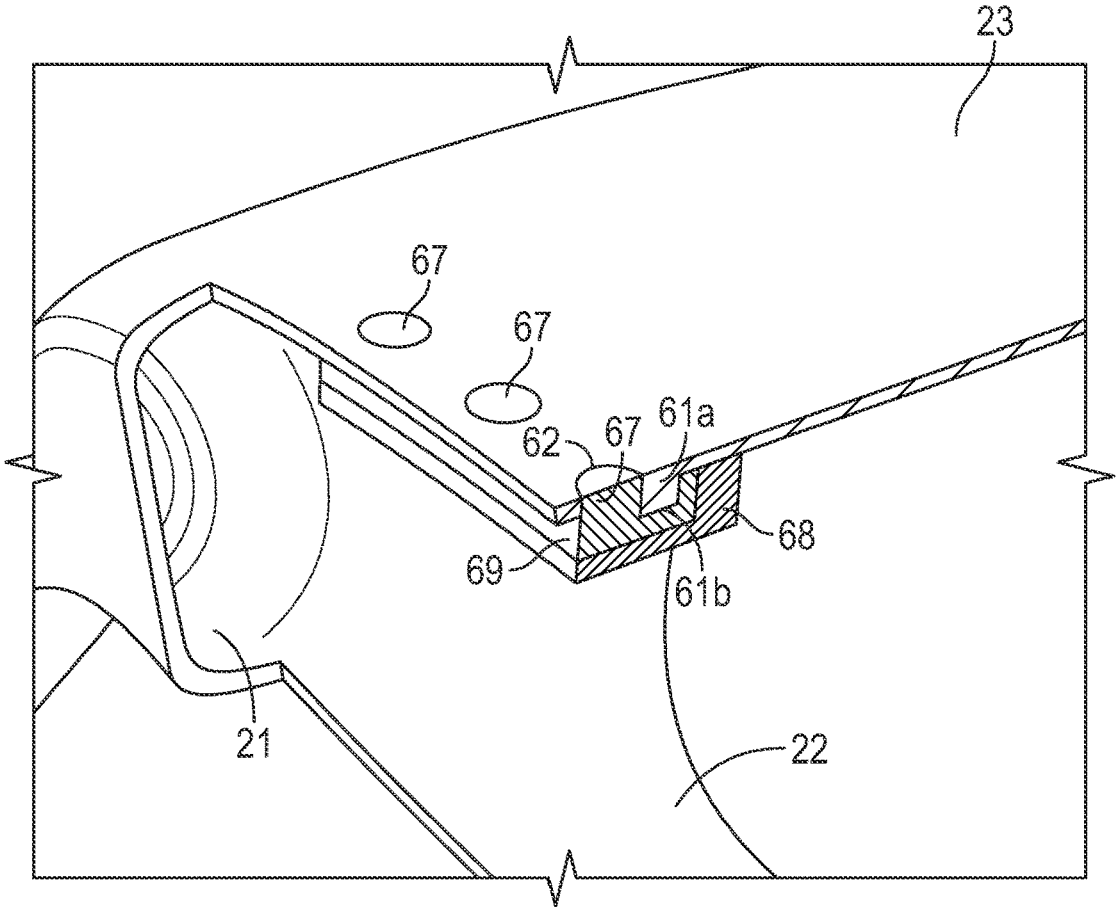
FIG. 25 is a cross-sectional view of the embodiment shown in FIG. 24 taken along lines 25-25.
Figure 26:
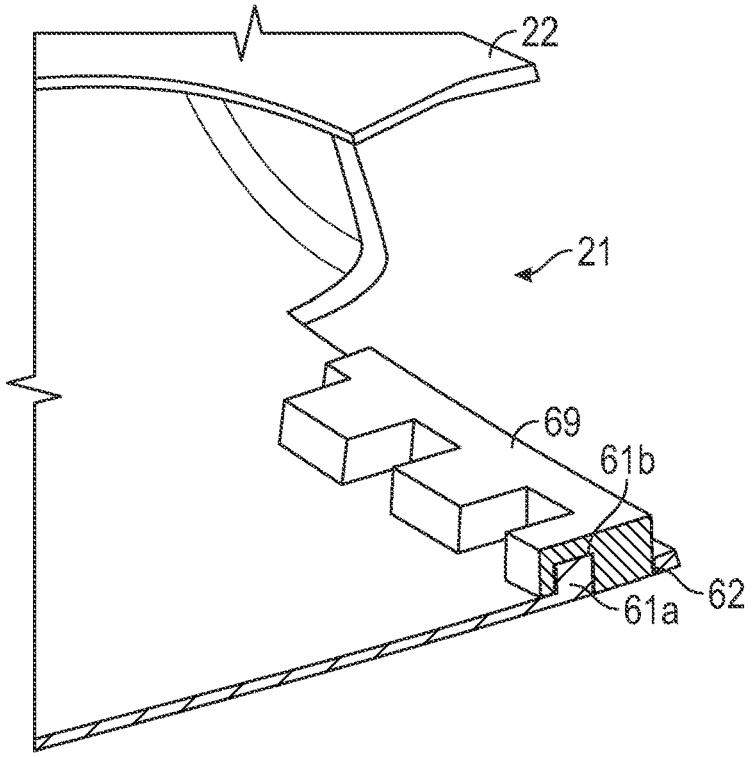
FIG. 26 is a side view of the embodiment shown in FIG. 25 with the inner portion of the filler piece removed.
Figure 27:
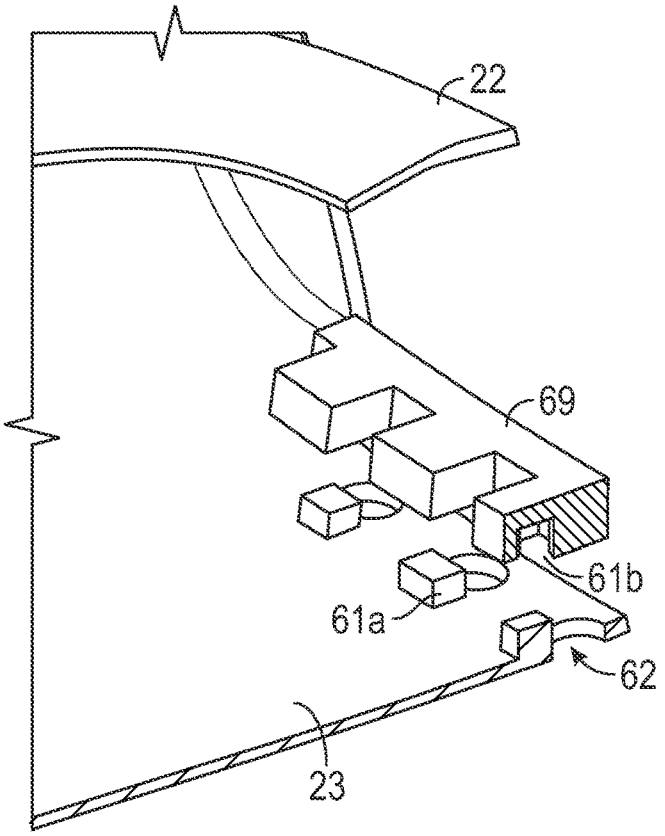
FIG. 27 is an exploded view of the embodiment shown in FIG. 26.
Figure 28:
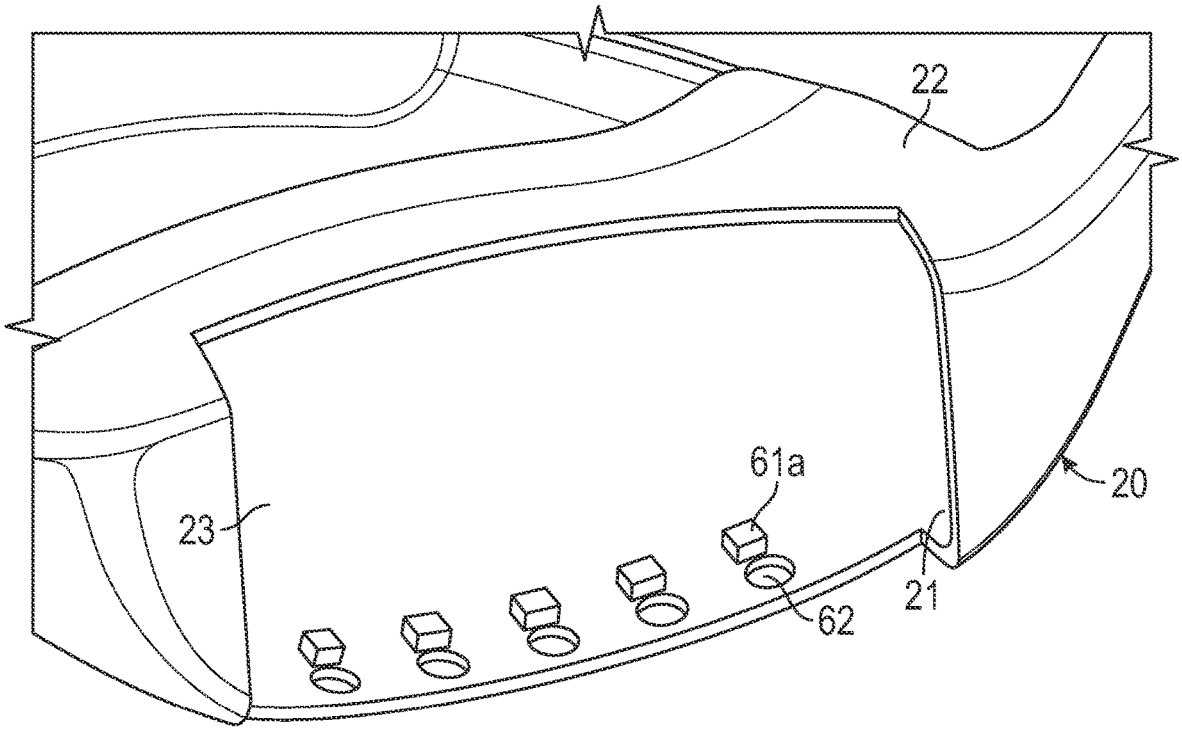
FIG. 28 is a front perspective view of the embodiment shown in FIGS. 20-21 with the filler piece removed.
Figure 29:
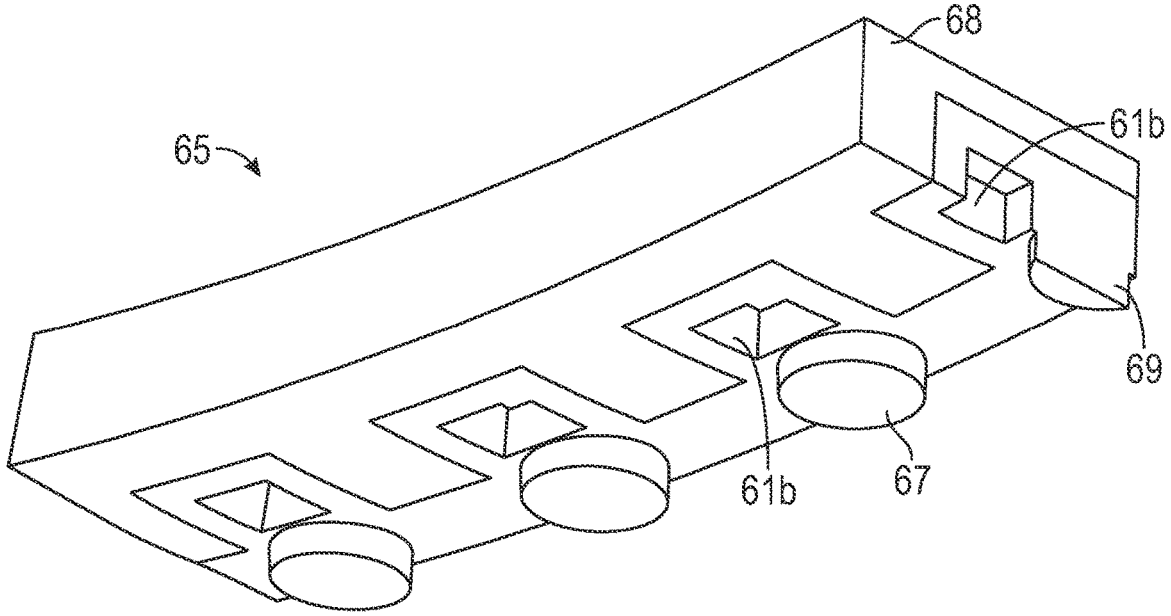
FIG. 29 is a bottom perspective view of the filler piece shown in FIG. 22.

In each of the embodiments, the sole 23 within the compliance zone 60 preferably has a variable thickness ranging from 0.01 to 0.05 inch, and may be optimized using artificial intelligence, machine learning, gradient-based optimization methods or stochastic optimization methods. As shown in FIG. 5A, in the first embodiment, the face deflects downwards a first distance D1. In an alternative embodiment that includes a solid chunk of steel on the inside of the sole 23, shown in FIG. 5B, the face deflects downwards a second distance D2 that is less than D1. In a sole thickness optimized embodiment, shown in FIG. 5C, the face deflects downwards a third distance D3 that is greater than both D1 and D2.

Any of the embodiments disclosed herein may be combined with an internal weight that bridges a portion of the sole, such as those disclosed in U.S. Pat. Nos. 8,257,195, 8,328,661, 8,414,420, 8,425,346, 8,900,070, 8,926,448, 9,211,451, 9,782,652, and 10080932, the disclosure of each of which is hereby incorporated by reference in its entirety herein. This further improves the performance characteristics of the club.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. The section titles included herein also are not intended to be limiting. Therefore, the embodiments of the invention in which an exclusive property or privilege is claimed are defined in the following appended claims.

We claim:

1. A golf club head comprising:

a body comprising a face portion with a face opening, a return section, a sole section, a heel side, a toe side, an aft end, and a hosel;

a crown insert;

a face cup sized to fit within the face opening; and at least one plug, wherein the sole section comprises a compliance zone located within three inches of the face portion measured along a front-to-back x-axis, wherein the compliance zone comprises a plurality of through-openings, and wherein each of the plurality of through-openings is filled with the at least one plug.

2. The golf club head of claim 1, wherein at least one of the plurality of through-openings is circular.

3. The golf club head of claim 1, wherein the plurality of through-openings comprises twenty through-openings.

4. The golf club head of claim 3, wherein the at least one plug comprises twenty plugs, and wherein each of the twenty through-openings is filled with one of the twenty plugs.

5. The golf club head of claim 1, wherein the golf club head is a fairway wood-type golf club head.

6. The golf club head of claim 1, wherein the at least one plug is a secondary filler piece comprising a base portion and a plurality of extensions, wherein each of the plurality of extensions extends from the base portion, and wherein each of the plurality of extensions fills one of the plurality of through-openings.

7. The golf club head of claim 6, wherein the secondary filler piece comprises an inner portion and a cover piece, wherein the inner piece is composed of a high-density material, and wherein the cover piece is composed of a material having a lower density than the high density material.

8. The golf club head of claim 7, wherein the inner portion is metal injection molded.

9. The golf club head of claim 7, wherein the cover piece is overmolded over the inner portion.

10. The golf club head of claim 7, wherein the cover piece comprises each of the plurality of extensions.

11. The golf club head of claim 6, further comprising a plurality of pegs extending from an interior surface of the sole portion within the compliance zone, wherein each peg of the plurality of pegs is disposed behind a through-opening of the plurality of through-openings, wherein the base portion of the secondary filler piece comprises a plurality of sockets, and wherein each peg of the plurality of pegs is sized to fit within a socket of the plurality of sockets.

12. The golf club head of claim 1, wherein the plurality of through-openings is disposed proximate to and is aligned parallel with the face opening.

13. The golf club head of claim 1, wherein the plurality of through-holes vary in shape, size, and length across the compliance zone.

14. The golf club head of claim 1, wherein the compliance zone comprises a variable thickness ranging from 0.01 inch to 0.05 inch.

15. The golf club head of claim 1, wherein each of the face cup and the body is composed of a metal material, and wherein the crown insert is composed of a non-metal material.

16. The golf club head of claim 1, wherein the face cup is composed of a first metal material, wherein the body is composed of a second metal material, and wherein the first metal material is different from the second metal material.

17. A fairway wood golf club head comprising:

a body comprising a face portion with a face opening, a crown section, a sole section, a heel side, a toe side, an aft end, and a hosel;

a face component sized to fit within the face opening; and a filler piece comprising a base portion, a plurality of extensions, an inner portion composed of a first material, and a cover piece composed of a second material that has a lower density than the first material, wherein the sole section comprises a compliance zone located within three inches of the face portion measured along a front-to-back x-axis, wherein the compliance zone has a variable thickness ranging from 0.01 inch to 0.05 inch and comprises a plurality of through-openings, wherein each of the plurality of through-openings is filled with an extension of the plurality of extensions, and wherein the face component is selected from the group consisting of a face insert and a face cup.

18. The fairway wood golf club head of claim 17, wherein the plurality of through-openings is disposed proximate to and is aligned parallel with the face opening.

19. The fairway wood golf club head of claim 17, wherein the plurality of through-holes vary in shape, size, and length across the compliance zone.

20. The fairway wood golf club head of claim 17, wherein the cover piece comprises each of the plurality of extensions.

* * * * *